United States Patent [19]

Nishioka et al.

[11] 3,953,820

[45] Apr. 27, 1976

[54] VARIABLE RESISTOR

[75] Inventors: Matsuo Nishioka, Hirakata; Yasuo Takeyoshi, Kadoma; Shunzo Oka, Hirakata, all of Japan

[73] Assignee: Matsushita Electric Industrial Company, Ltd., Osaka, Japan

[22] Filed: Aug. 29, 1974

[21] Appl. No.: 501,432

[52] U.S. Cl. ..... 338/89; 338/138

[51] Int. Cl.[2] ..... H01C 10/04

[58] Field of Search ..... 338/89, 90, 91, 138, 338/141, 142, 180, 181, 217, 218

[56] References Cited

UNITED STATES PATENTS

| | | | |
|---|---|---|---|
| 2,795,758 | 6/1957 | Cahn, Jr. | 338/89 X |
| 2,936,436 | 5/1960 | Roberts | 338/141 |
| 2,992,387 | 7/1961 | Austin | 338/89 X |
| 3,105,215 | 9/1963 | Seibold, Sr. | 338/138 |
| 3,162,833 | 12/1964 | MacLain | 338/89 |
| 3,284,697 | 11/1966 | May | 323/74 |
| 3,317,877 | 5/1967 | Matsumoto | 338/89 |

*Primary Examiner*—Volodymyr Y. Mayewsky
*Attorney, Agent, or Firm*—Stevens, Davis, Miller & Mosher

[57] ABSTRACT

A variable resistor provided with a mechanism which permits the tap resistance to be varied non-linearly; that is, the mechanism permits a contactor to be displaced at a varying rate in response to the operation of input means at a constant rate.

1 Claim, 6 Drawing Figures

FIG. 1
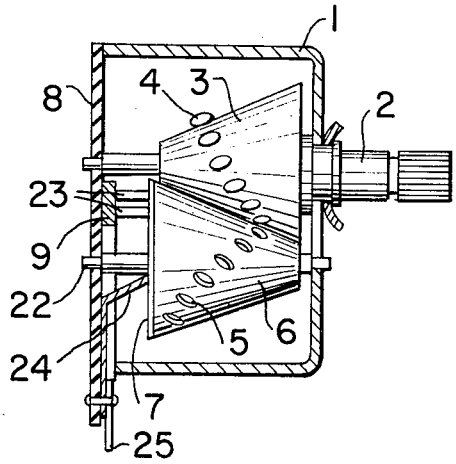
FIG. 2
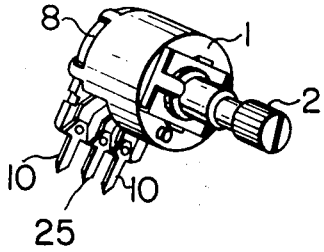
FIG. 3
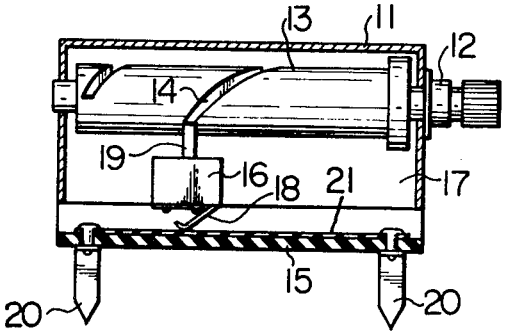
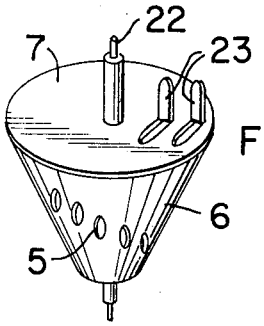
FIG. 1B
FIG. 4
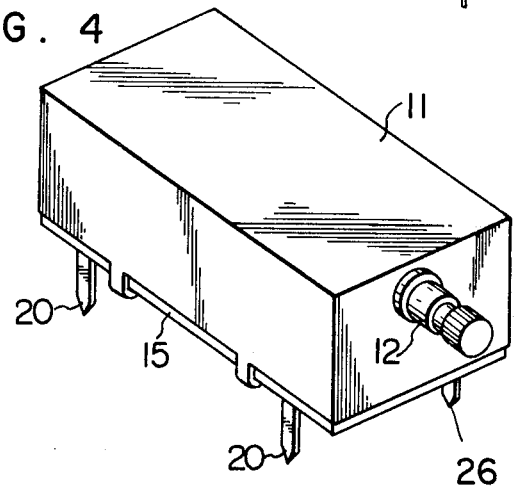
FIG. 1A
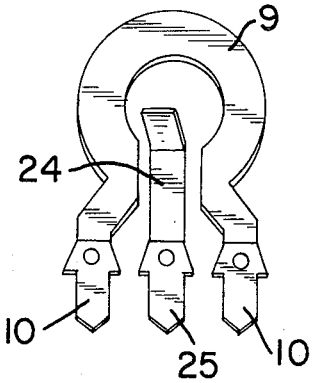

VARIABLE RESISTOR

This invention relates to improvements in variable resistors.

Heretofore, resistance change curves of variable resistors have usually been obtained by coating or spraying different types of resistive liquid onto a base in a number of steps. However, uniform coating or spraying cannot be achieved. For this reason, standard resistor cannot be directly obtained, and it has been necessary to correct the resistance change characteristic by cutting a resistance element or coating carbon. Also, the characteristic of the variable resistor is greatly affected by the frictional movement noise.

In the light of the prior-art defficiencies, it is an object of the invention to provide a variable resistor, which has a mechanism for providing a desired resistance change curve.

According to the invention, there is provided a variable resistor having a great practical value in that it has the same appearance and shape as those of the conventional rotary variable resistor and can be manufactured more simply and at a reduced cost.

In order for the invention to be fully understood, it will now be described in conjunction with the accompanying drawings, in which:

FIG. 1 is a sectional view of an embodiment of the variable resistor according to the invention;

FIG. 1*a* shows a resistive element and a contact element used in the variable resistor illustrated in FIG. 1 and FIG. 1*b* shows a second conical member used in the variable resistor illustrated in FIG. 1.

FIG. 2 is a perspective view of the same;

FIG. 3 is a sectional view of another embodiment of the variable resistor according to the invention; and FIG. 4 is a perspective view of the same.

Referring now to FIGS. 1, 1a, 1b and 2, which show a specific embodiment of the invention, there is shown a casing 1, within which extends a first rotatable conical member 3 secured to an operating shaft 2. The first conical member 3 made of insulating material has helically arranged protuberances 4 formed in its periphery. Also extending within the casing is a second conical member 6 made of insulating material, which is secured to a shaft 22 parallel to the shaft 2 and is orientated oppositely to and in rolling contact with the first conical member 3. Insulating or conductive material can be used as the shaft 22. When conductive material is used as the shaft 22, the shaft 22 must be electrically insulated from the contactor 7 and resistor 9. The second conical member 6 is provided in its periphery with helically arranged recesses 5 in meshing relation to the protuberances 4. The second conical member 6 has a contactor 7 which is made of conductive material and extends from its base and in frictional contact with a resistor 9 formed on a base 8 which is made of insulation material and provided on the bottom of the casing 1. Numerals 10 and 25 designate terminals. Numeral 23 designates a pair of brushes and numeral 24 designates a contact element made of conductive material and having a 45° bend.

With this construction of the variable resistor according to the invention, with rotation of the first conical member 3 caused by operating the operating shaft 2 the second conical member 6 is driven to cause revolution of the contactor 7, thereby varying the resistance to obtain variation in output voltage. Since the conical members 3 and 6 are coupled together by means of the protuberances 4 and recesses 5 which are provided on the conical members 3 and 6 and in helical engagement with each other, with change in the rotational angle of the first conical member 3 the second conical member 6 undergoes rotational displacement after a certain curve. Thus, in the variable resistor section coupled to the second conical member 6 a desired curve of resistance change may be obtained.

Another embodiment of the variable resistor according to the invention will now be described with reference to FIGS. 3 and 4. Numeral 11 designates a casing. Mounted in opposite end walls of the casing is an operating shaft 12 carrying a cylindrical rotative member 13 integral therewith. The rotative member 13 has a helical groove 14 which is cut on its periphery. A resistor base 15 made of insulating material extending parallel to the rotative member 13 is provided on the bottom of the casing 11, and a slider 16 is provided between the rotative member 13 and resistor base 15. The slider 16 is adapted to be moved linearly along a guide 17, and it has a contactor 18 extending from its underside and in frictional contact with the surface of the resistor 21 on the resistor base 15 and also has an outer projection 19 with the top thereof engaged in the helical groove 14 of the rotative member 13. The contact 18 is electrically connected with an output terminal 26 shown in FIG. 4.

With this construction, by rotating the operating shaft 13 the rotative member 13 is rotated in unison therewith. Thus, the slider 16 coupled to the helical groove 14 can be moved over the resistor base 15 to obtain a voltage variation. Here, the pitch of the helical groove 14 formed in the rotative member 13 is made to vary with the axial distance such that the displacement of the slider 16 per unit of rotational angle is not constant. Thus, it is possible to obtain a given curve of the resistance change required for the variable resistor.

As has been described, with the variable resistor according to the invention a desired characteristic of the resistance change can be obtained since the rotation of the operating shaft is transmitted to the contactor through two oppositely orientated conical members in rolling contact with each other and coupled to each other through protuberances and recesses in helical arrangement or through a slider coupled to a helical groove of non-constant pitch formed in a rotative member. Thus, it is possible to use a resistor whose resistance changes linearly with displacement of the tap. This means that only a single step of coating or spraying of resistive liquid is needed, so that manufacture of the device can be simplified. Also, the outer shape of the variable resistor itself may be made the same as conventional rotary and linear type, so that no inconvenience or problem will be encountered in use.

What we claim is:

1. A variable resistor device comprising:

a casing;

a first conical non-conductive member rotatably mounted within said casing, said first conical member having a plurality of helically arranged peripheral protuberances on the surface thereof;

operating shaft means for rotating said first conical member;

a second conical non-conductive member rotatably mounted within said casing, said second conical member being oriented invertedly with respect to and in rolling contact with said first conical member and having a plurality of helically arranged peripheral recesses meshing with said plurality of peripheral protuberances, said second conical member being driven by said first conical member;

a conductive contactor extending from the base of said second conical member;

a dielectric base plate secured to said casing;

a variable resistor and an electrical contact element secured to said base plate, said contact element being in frictional contact with said contactor; and brush means electrically connecting said contactor with said variable resistor, said contact element being displaced at a varying rate as said operating shaft is rotated at a constant rate thereby providing a non-linear resistance characteristic.

* * * * *